US006976282B2

(12) United States Patent
Sie

(10) Patent No.: US 6,976,282 B2
(45) Date of Patent: Dec. 20, 2005

(54) DUAL-FUNCTION CLEANING DEVICE

(76) Inventor: Jai Yi Sie, No. 357-2, Sec 1 Jhonghua Road, Wuci Township, Taichung County, 435 (TW)

( * ) Notice: Subject to any disclaimer, the term of this patent is extended or adjusted under 35 U.S.C. 154(b) by 260 days.

(21) Appl. No.: 10/611,343

(22) Filed: Jun. 30, 2003

(65) Prior Publication Data

US 2004/0158947 A1 Aug. 19, 2004

(30) Foreign Application Priority Data

Feb. 14, 2003 (TW) ..... 92202488 U

(51) Int. Cl.[7] ..... A47L 13/144; A47L 13/146
(52) U.S. Cl. ..... 15/119.2; 15/116.2
(58) Field of Search ..... 15/119.1, 119.2, 15/116.1, 116.2

(56) References Cited

U.S. PATENT DOCUMENTS

| | | | | |
|---|---|---|---|---|
| 2,651,069 | A * | 9/1953 | Hoffman | 15/119.2 |
| 2,730,744 | A * | 1/1956 | Vaugha | 15/119.2 |
| 2,762,070 | A * | 9/1956 | Tingley | 15/119.2 |
| 3,224,025 | A * | 12/1965 | Altrock | 15/119.2 |
| 3,289,233 | A * | 12/1966 | Smyth et al. | 15/116.1 |
| 4,971,471 | A * | 11/1990 | Sloan | 401/203 |
| 5,887,309 | A * | 3/1999 | Lin | 15/119.2 |
| 6,785,928 | B2 * | 9/2004 | Specht et al. | 15/119.2 |

* cited by examiner

*Primary Examiner*—Gary K. Graham
(74) *Attorney, Agent, or Firm*—Charles E. Baxley

(57) ABSTRACT

A cleaning device includes a rod having a frame connected to an end thereof and a connection member is connected to two assist plates which movably extend through the frame and pivotably connected to a pull handle on the rod. Two boards are pivotably connected to two sides of the connection member and each board has a positioning member to which a cleaning member is secured.

5 Claims, 6 Drawing Sheets

DUAL-FUNCTION CLEANING DEVICE

FIELD OF THE INVENTION

The present invention relates to two-function cleaning device that has two pivotable boards which are able be pivoted toward each other. A static fabric and a sponge are alternatively installed to the pivotable boards.

BACKGROUND OF THE INVENTION

A conventional cleaning device such as a mop generally includes a rod and a sponge is connected to an end of the rod. Two rollers are connected to two assist plates which are pivotably connected to the rod. The sponge is located between the two rollers so that when pulling the assist plates, the sponge is squeezed by the two rollers. Another type of the cleaning device employs a static fabric which is convenient to remove dust and small particles on floor. The sponge is soaked before use to wipe the marble or stone-related floor, the static fabric cannot be used with water and is used on wood floor. The two types of cleaning devices each have their specific function so that most of the users have to purchase them so as to clean their wood floor and marble floor.

The present invention intends to provide a cleaning device wherein a sponge and a static fabric can be alternatively used.

SUMMARY OF THE INVENTION

In accordance with one aspect of the present invention, there is provided a cleaning device which comprises a rod having a frame connected to an end thereof and two assist plates movably extend through the frame. Two respective first ends of the two assist plates are pivotably connected to a pull handle which is pivotably connected to the rod. Two respective second ends of the two assist plates are pivotably connected to a connection member located in the open end of the frame.

Two boards are pivotably connected to two sides of the connection member and each board has a positioning member which secures a cleaning member to each of the boards.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
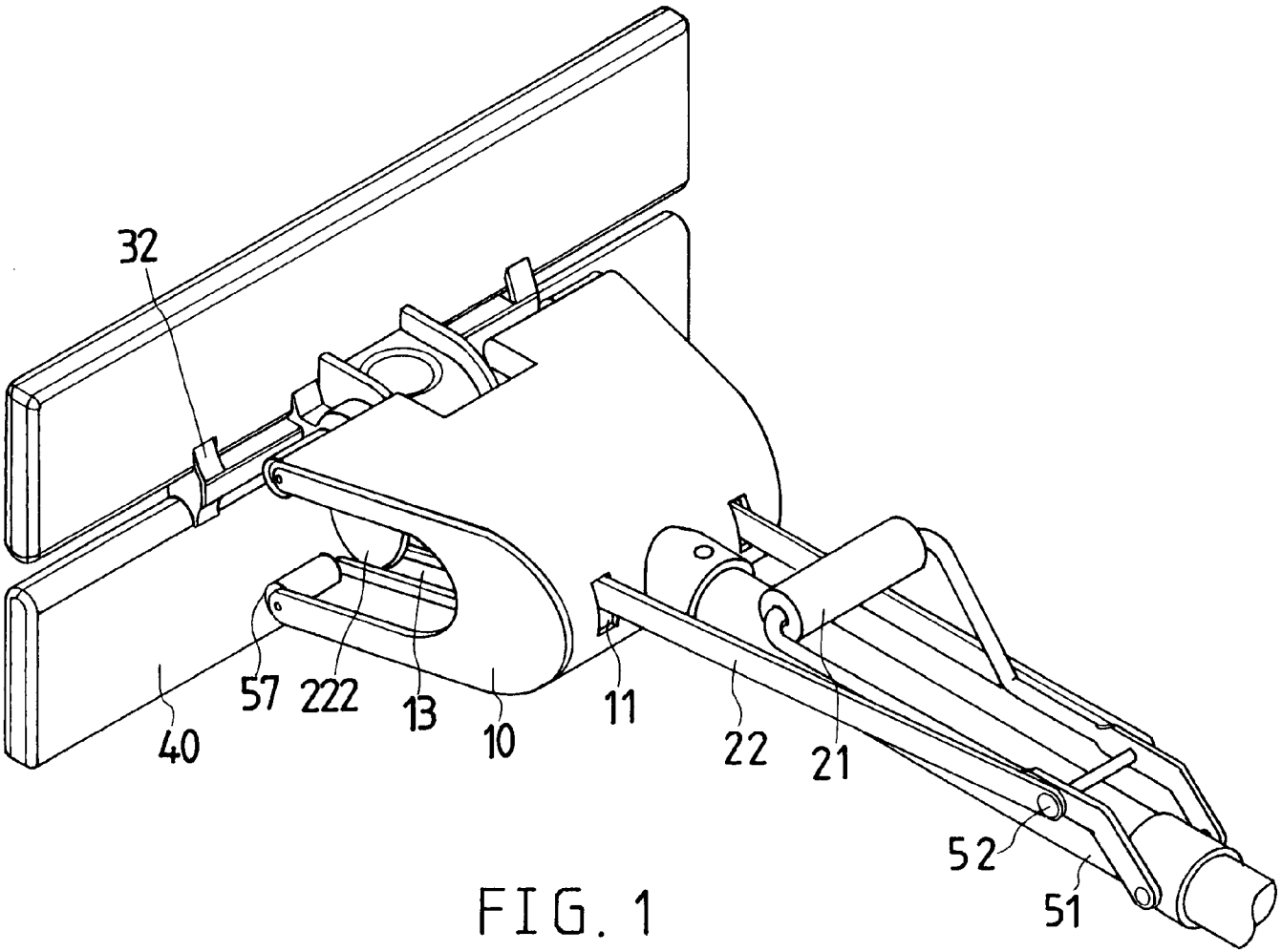
FIG. 1 is a perspective view to show the cleaning device of the present invention.
Figure 2:
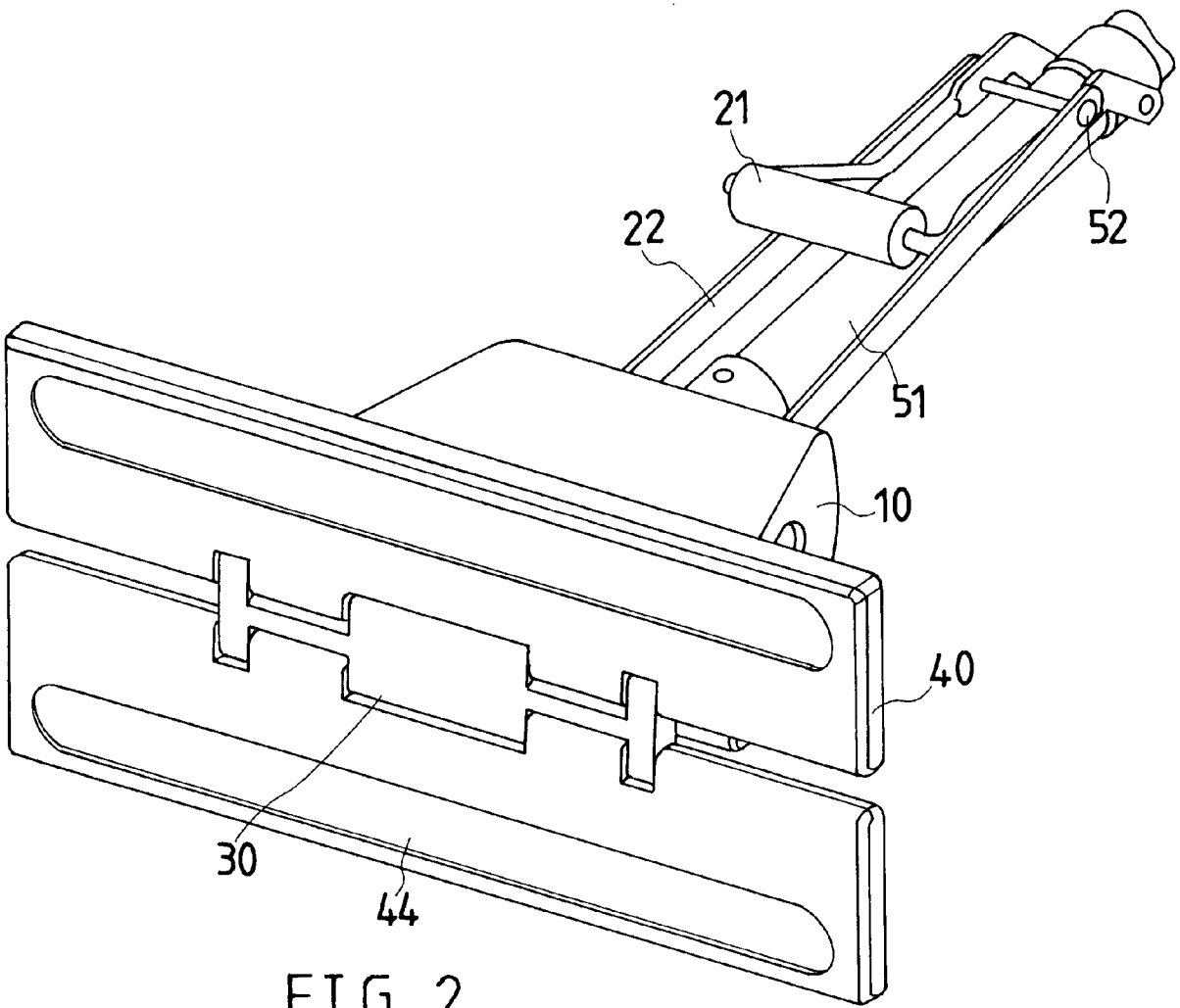
FIG. 2 shows the cleaning device viewed from the underside of the two boards.
Figure 3:
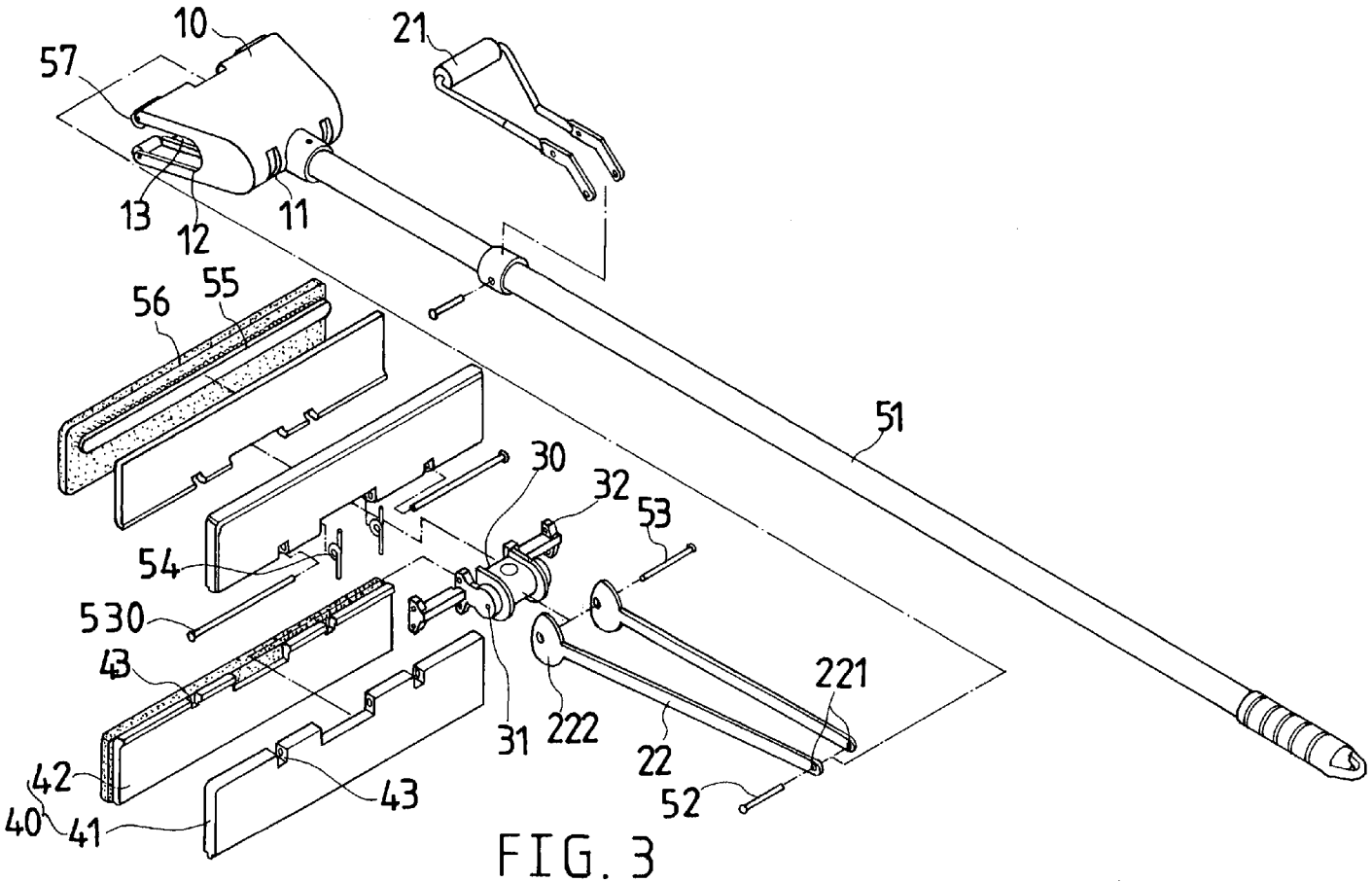
FIG. 3 is an exploded view to show the cleaning device of the present invention.
Figure 4:
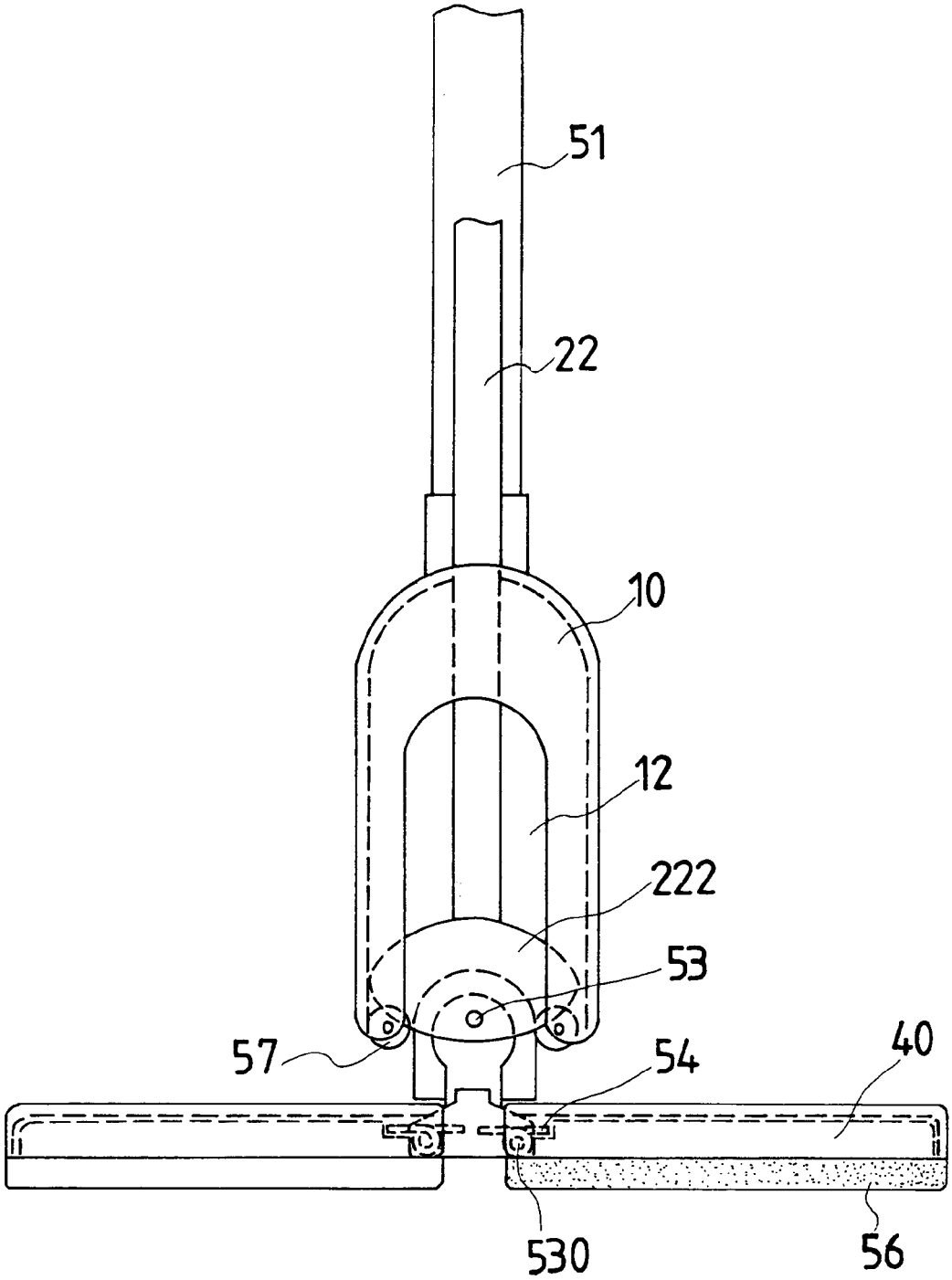
FIG. 4 shows the two boards are located in horizontal portion.

Referring to FIGS. 1 to 4, the cleaning device of the present invention comprises a rod 51 and a frame 10 is connected to an end of the rod 51. The frame 10 has an open end and two recesses 12 are defined in two sides of the frame 10. The two recesses 12 communicate with the open end of the frame 10. Two grooves 13 are defined in each of two insides of the frame 10. Four rollers 57 are located to an inside of the two insides of the open end of the frame 10.

Two assist plates 22 movably extend through two holes 11 in the frame 10. Two respective first ends of the two assist plates 22 are pivotably connected to a pull handle 21 by a pin 52 and the pull handle 21 is pivotably connected to the rod 10. Two respective second ends of the two assist plates 22 are pivotably connected to a connection member 30 located in the open end of the frame 10 by a pin 53. The two respective second ends of the assist plates 22 each are in a form of oval board 222, two ends of a long axis of the two oval boards 222 are movably engaged with the grooves 13 in two insides of the frame 10.

Two boards 40 are pivotably connected to two sides of the connection member 30 and each board 40 has a groove 44 for receiving a positioning member 55 therein which secures a cleaning member 56 to each of the boards 40. The positioning member 55 can be a loop-hook member so as to secure the cleaning member 56 such as a static fabric or a sponge. In other words, the user may replace the static fabric with the sponge, or vice versa.

The connection member 30 includes two connection branches which extend from two ends of the connection member 30. Each connection branch has two connection protrusions 32.

Each board 40 includes a cover 41 and a base 42 which is engaged with the cover 41. A plurality of notches 43 are defined in a side of the combination of the cover 41 and the base 42 so that the connection protrusions 32 are pivotably engaged with the notches 43 of the boards 40 by pins 530. A torsion spring 54 is mounted to each pin 530 so as to maintain the two boards 40 in expanded position.

Figure 5:
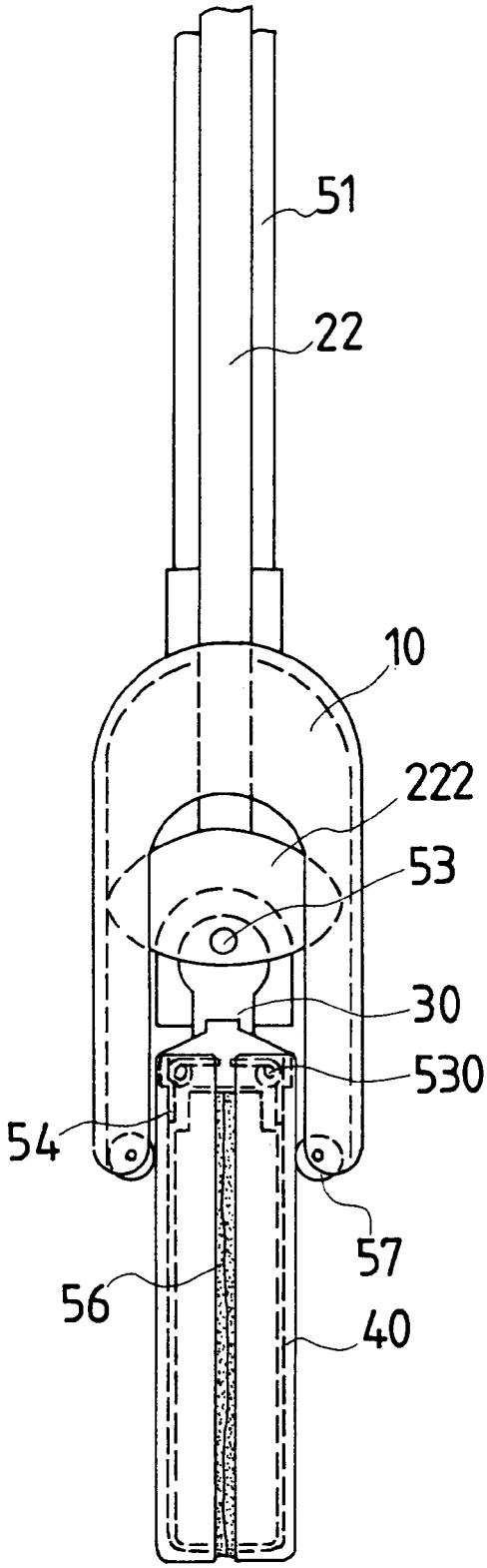
FIG. 5 shows the two boards are pivoted toward each other and pulled toward the frame.

As shown in FIG. 5, when pivoting the pull handle 21, the assist plates 22 pull the connection member 30 upward so that the two boards 40 are pivoted toward each other. If the sponges are used on the boards 40, the sponges are squeezed and the water is removed from the sponges. The boards 40 are pivoted to close together and this is convenient for being stored.

Figure 6:
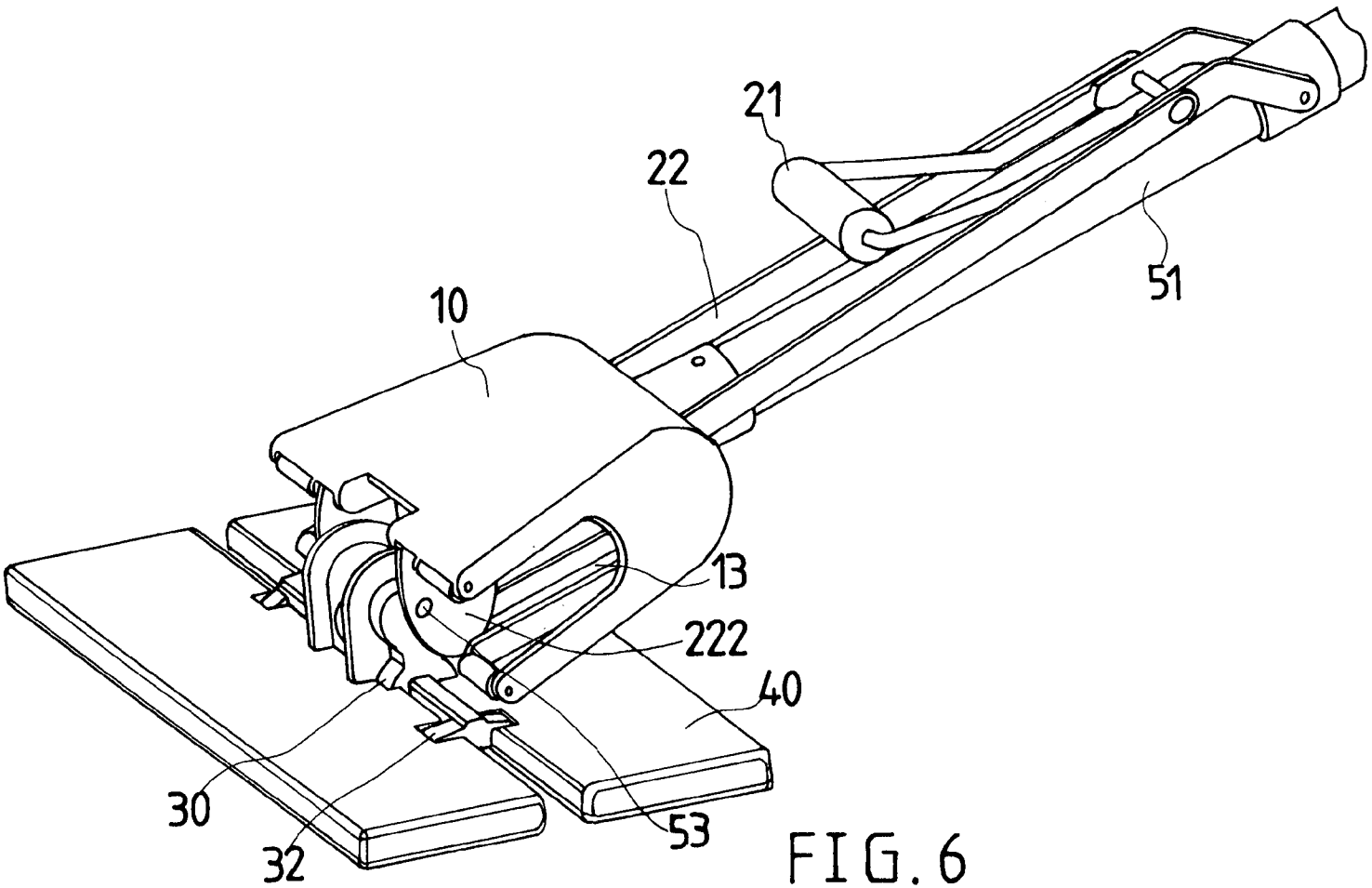
FIG. 6 shows that the handle is able to be pivoted an angle relative to the two boards.

As shown in FIG. 6, the rod 51 is allowed to be pivoted an angle relative to the boards 40 so that the boards 40 may reach a narrow space.

While we have shown and described the embodiment in accordance with the present invention, it should be clear to those skilled in the art that further embodiments may be made without departing from the scope of the present invention.

What is claimed is:

1. A cleaning device comprising:

a rod having a frame connected to an end thereof and two assist plates movably extending through the frame, the frame having an open end and two grooves defined in each of two insides of the frame, two respective first ends of the two assist plates pivotably connected to a pull handle which is pivotably connected to the rod, two respective second ends of the two assist plates pivotably connected to a connection member located in the open end of the frame, the two respective second ends of the assist plates each being in a form of oval board, two ends of a long axis of each of the two oval boards movably engaged with the grooves in two insides of the frame, and two boards pivotably connected to two sides of the connection member and each board having a positioning member which is adapted to secure a cleaning member to each of the boards.

2. The cleaning device as claimed in claim 1, wherein rollers are located in said two insides of the open end of the frame and two recesses are defined in two sides of the frame, the two recesses communicating with the open end of the frame.

3. The cleaning device as claimed in claim 1, wherein each board includes a cover and a base which is engaged with the cover, a plurality of notches defined in a side of the combination of the cover and the base, the connection member including two connection branches extending from two ends of the connection member, each connection branches having connection protrusions which are pivotably engaged with the notches of the boards by pins.

4. The cleaning device as claimed in claim 3, wherein a torsion spring is mounted to each pin so as to maintain the two boards in expanded position.

5. The cleaning device as claimed in claim 1, wherein the positioning member is a loop-hook member.

* * * * *